US011718953B2

(12) United States Patent
Zhang

(10) Patent No.: US 11,718,953 B2
(45) Date of Patent: Aug. 8, 2023

(54) FABRIC AND A NEW LEATHER PRODUCT WITH COLLAGEN FIBER BUNDLES FORMING A RETICULAR STRUCTURE

(71) Applicant: Guangdong Wuyuan New Material Technology Group Co., Ltd., Guangzhou (CN)

(72) Inventor: Liwen Zhang, Guangzhou (CN)

(73) Assignee: GUANGDONG WUYUAN NEW MATERIAL TECHNOLOGY GROUP CO., LTD., Guangzhou (CN)

( * ) Notice: Subject to any disclaimer, the term of this patent is extended or adjusted under 35 U.S.C. 154(b) by 0 days.

(21) Appl. No.: 17/266,821

(22) PCT Filed: Mar. 15, 2019

(86) PCT No.: PCT/CN2019/078252
§ 371 (c)(1),
(2) Date: Feb. 8, 2021

(87) PCT Pub. No.: WO2020/073602
PCT Pub. Date: Apr. 16, 2020

(65) Prior Publication Data

US 2021/0348325 A1 Nov. 11, 2021

(30) Foreign Application Priority Data

Oct. 9, 2018 (CN) ..... 201811175017.5

(51) Int. Cl.
*D06N 3/00* (2006.01)
*D03D 15/208* (2021.01)

(52) U.S. Cl.
CPC ..... *D06N 3/0006* (2013.01); *D03D 15/208* (2021.01); *D06N 3/0018* (2013.01); *D06N 2209/103* (2013.01); *D06N 2211/28* (2013.01)

(58) Field of Classification Search
CPC .. D06N 3/0018; D06N 3/0006; D06N 3/0009; D06N 3/004; D03D 15/233;
(Continued)

(56) References Cited

U.S. PATENT DOCUMENTS

2007/0186352 A1* 8/2007 Zhang ..... D02G 3/10 8/94.11
2017/0233537 A1* 8/2017 Purcell ..... D04H 1/43838 442/1
2017/0362750 A1* 12/2017 Sasase ..... D04B 1/04

FOREIGN PATENT DOCUMENTS

CN 101235579 A * 8/2008
CN 101235579 A 8/2008
(Continued)

OTHER PUBLICATIONS

"CN101235579_Machine Translation" is a machine translation of CN-101235579-A. (Year: 2008).*
(Continued)

*Primary Examiner* — Larissa Rowe Emrich
(74) *Attorney, Agent, or Firm* — Dinsmore & Shohl LLP

(57) ABSTRACT

A fabric and a leather product in which collagen fiber bundles form a network structure has a base yarn woven layer, and also has collagen fiber bundles. The collagen fiber bundles sheathed in the base yarn woven layer protrude on the surface of the base yarn woven layer, and the protruding collagen fiber bundles and their branches are interwoven to form a network structure, where a part of the branches in the collagen fiber bundle is sheathed on the base yarn so that at least one end of the branch protrudes from the base yarn braided layer. Leather products may include these fabrics and leather surface layers.

6 Claims, 3 Drawing Sheets

(58) Field of Classification Search
CPC .. D03D 15/00; D03D 15/63; D03D 27/12–16; D10B 2211/06; D04B 1/04; D04B 21/04; D04B 1/14; D02G 3/04; D02G 3/10; D02G 3/38; B32B 5/26; B32B 5/275; B32B 5/279; B32B 2262/08
See application file for complete search history.

(56) References Cited

FOREIGN PATENT DOCUMENTS

| | | | | |
|---|---|---|---|---|
| CN | 205044250 | U | | 2/2016 |
| CN | 105671723 | A | * | 6/2016 |
| CN | 107107585 | A | | 8/2017 |
| CN | 109082763 | A | | 12/2018 |

OTHER PUBLICATIONS

"CN105671723_Machine Translation" is a machine translation of CN-105671723-A. (Year: 2016).*
"Braid." and "Braided Fabric." Complete Textile Glossary, New York, NY: Celanese Acetate, 2001. N. pag. Print. (Year: 2001).*

* cited by examiner

FABRIC AND A NEW LEATHER PRODUCT WITH COLLAGEN FIBER BUNDLES FORMING A RETICULAR STRUCTURE

REFERENCE TO RELATED APPLICATIONS

This application is a U.S. national stage of PCT/CN2019/078252, filed Mar. 15, 2019 which claims priority to Chinese patent application No. 201811175017.5, filed Oct. 10, 2018. The entire content of both of which is incorporated herein by reference.

TECHNICAL FIELD

The disclosure relates to a novel fabric and a new leather product in which collagen fiber bundles form a network structure.

BACKGROUND

Leathermaking mainly uses animal skin. The longitudinal section of animal skin is divided into three layers: epidermis, dermis and subcutaneous tissue. The dermis is between the epidermis and subcutaneous tissue, and the dermis is divided into the papillary layer and the reticular layer. The papillary layer is a thin layer of loose connective tissue close to the epidermis layer, protruding to the epidermis layer to form the dermal papilla; after the leather is formed, the surface of the papillary layer is also called the grain surface of the leather, so this layer is called the grain layer in the leather industry. The reticular layer is thick and dense connective tissue beneath the papillary layer, with thick collagen fiber bundles interwoven into a network, giving the leather greater elasticity and toughness.

Tanning refers to the process of tanning raw hides into leather. Hair and non-collagen fibers are removed, the collagen fibers in the dermis layer are appropriately loosened, fixed and strengthened, and then a series of chemical and mechanical treatments such as finishing are applied to turn the skin into leather.

Animal leather is mainly composed of fiber components and non-fiber components. The fiber components are mainly composed of collagen fibers, elastic fibers and reticular fibers. The non-fiber components are composed of blood vessels, sweat glands, fat glands, hair follicles, muscles, lymphatic vessels, nerves, fibrous interstitium and adipocytes.

The weaving of collagen fiber bundles in the reticular layer can be divided into three types, namely rhombus, curved and corrugated. The characteristic of rhombus weaving is that the collagen fiber bundles are thick and straight, and cross weave at a large angle to form a rhombus. The more developed the reticular layer, the more obvious the characteristics of this weave. The characteristic of curved weaving is that the collagen fiber bundles are thin and curved, and they are interwoven parallel to the surface of the animal leather to form loops, branches or other various shapes. Corrugated weaving is characterized by thin and loose collagen fiber bundles, which are cross-woven parallel to the surface of animal leather.

The elastic fibers in animal leather are like steel bars in construction, fixing other tissues in animal leather, such as hair follicles, sweat glands, fat glands, blood vessels, etc., in a certain position, thus playing a role of support and skeleton in animal leather.

The reticular fibers are composed of hard proteins. In morphology, the reticular fibers are not bundled like collagen fibers, but branched and united. In nature, they are similar to collagen fibers. The reticular fibers form a dense omentum and surround the surface of the collagen fiber bundles to form a loose net sheath. The bundles protect the fiber bundles. In the tanning process, the reticular fibers play a certain role in restricting the loosening of the collagen fiber bundles.

Between the fiber structure and cell tissue of animal leather, there is a gelatinous substance, which is mainly composed of albumin, globulin, mucin, mucin-like protein, and carbohydrates. The gelatinous substance is called interfibrous substance. They infiltrate the collagen fibers to play a lubricating effect. When the animal leather gradually loses water, the fibrous interstitium will solidify and harden, making the fiber structure of the animal leather tightly bonded, and the animal leather becomes abnormally hard. In the tanning preparation process, it is very important to remove the fibrous interstitium in the skin, so as to ensure the looseness of the fiber structure and the penetration of chemicals. However, in the actual processing process, due to the special structure of animal leather, it is difficult to completely remove the fibrous interstitium.

Based on the above-mentioned structure of animal leather, (1) in animal leather, not only collagen fiber bundles and their branches interspersed and interwoven to form a reticular structure, but between the collagen fiber bundles and between the collagen fiber bundles and other elastic fibers, reticular fibers, non-fibrous components, etc., together form a special three-dimensional reticular structure, in which elastic fibers play a role of support and skeleton in animal leather. (2) Collagen fiber bundles have different thickness structures in animal leather, so that collagen fiber bundles form different reticular structures in animal leather, such as rhombic net-like layers, curved reticular layers and wavy net-like layers, and formed in different layers in animal leather. (3) Because it is difficult to completely remove the fibrous interstitium during the tanning process, after the animal leather gradually loses water, the fibrous interstitial will solidify and become hard. In order to prevent the raw hides from hardening, fatliquors are usually added to the animal leathers, and the fatliquors are used for lubrication. Once the animal leather with the fatliquor is washed with water, the fatliquor will be lost and the hide becomes hard. Therefore, the animal leather is not suitable for washing with water.

Fur refers to the value-added products obtained by tanning, dyeing and finishing animal skins with fur, which is also known as fur coat. Fur is composed of two parts, fur quilt and leather board, and its value is mainly determined by fur quilt. The fur skin is flexible, and the leather board is loose, bright, beautiful, warm and durable, which can be used to make clothing, shawls, hats, collars, gloves, cushions, tapestries and toys. The hair in the fur grows from the hair follicle, and there is no "V" or "W" nesting structure between the hair and the animal leather. When the tanning is completed, the strength of the connection between the hair and the animal leather will vary depending on the structure of the animal leather.

The appearance of artificial fur is similar to the plush fabric of animal fur. Artificial fur is commonly used in coats, clothing linings, hats, collars, toys, cushions, interior decorations and carpets.

The manufacturing methods of artificial fur include knitting and weaving, etc. The knitting weft knitting method is the fastest growing and most widely used. When knitting, the carding mechanism disperses the top into a single fiber shape, and the knitting needle grabs the fiber and sets it into the base yarn for knitting. Because the fluff is in the shape of a "V" or "W" in the loop, it has the characteristics of setting the shape of the knitted base fabric and preventing hair loss. Because of the formation of fluff, the fluff tissue fabric is thick, soft, and has good warmth retention, which is suitable for making winter warm clothing.

Now the new generation of artificial fur surface layer is made of wool or blended of wool, polyester fiber, viscose, etc. It is difficult to distinguish between artificial and natural in ordinary burning methods, because after burning, there will be no sintering phenomenon, and they are all powder with a burnt wool smell.

In "Wool Spinning Science and Technology" in 2006, the 10th issue of "Weaving of Artificial Fur and its Application" specifically disclosed that the base yarn adopts natural fibers and/or synthetic fibers, and the fluff adopts synthetic fibers, among which acrylonitrile and modified acrylonitrile fiber are mainly used, of course, animal hair such as wool, mohair or alpaca can also be used as fluff. The structure is as follows: synthetic fiber or animal hair is sheathed into the bottom yarn to form a loop with the bottom yarn, and the head end of the synthetic fiber or animal hair protrudes from the surface of the knitted fabric to form a fluffy shape after finishing process.

In the "2017 National Knitting Technology Exchange Conference Proceedings", "The Production and Finishing of Knitted Artificial Fur" specifically disclosed the knitting of the artificial fur fabric, that is, the plush fabric, which is to feed and knit together fiber bundles or plush yarns into loops, and at the same time, make the head ends of the fiber bundle or plush yarn exposed to the surface of the fabric to form a plush shape. The plush on the surface of the plush fabric can be relatively neat velveteen, or it can be of different lengths, similar to the "bristles" and "fluff" of animal fur, and its appearance is very close to natural fur. The fluff is "V" or "W" in the loop.

A patent document with a Chinese patent application number of 201720073980.7 discloses an anti-dropping and anti-static artificial fur, comprising a base fabric, artificial wool, an adhesive layer, and a waterproof layer. The base fabric is a plain weave structure formed by weaving warp yarns and weft yarns up and down. The warp yarn is arranged at intervals by conductive fibers and other warp yarns. The two ends of the artificial wool pass through the weft between the adjacent warp yarns, and the two ends protrude from the front of the base fabric. The back of the base fabric is provided with an adhesive layer. The part of the artificial wool on the back of the base cloth is fixed by the adhesive layer in the adhesive layer, and a waterproof layer is arranged under the adhesive layer. Through the clamping of adjacent warp yarns and the fixation of the adhesive layer, the adhesion firmness of the artificial wool on the base fabric can be increased, and the shedding of the artificial wool can be reduced. The conductive fiber helps to disperse and transfer the generated static charge and neutralize and eliminate the charge through corona discharge, which can effectively inhibit the generation of static electricity and has a good antistatic effect.

A patent document with a Chinese patent application number of 201720074297.5 discloses a double-sided artificial fur, comprising base fabric 1, base fabric 2, artificial wool, adhesive layer 1, adhesive layer 2, adhesive layer 3, adhesive layer 4, antibacterial layer one 1 antibacterial layer 2 and waterproof layer. The base fabric 1 and base fabric 2 are a plain weave structure formed by interweaving warp yarns and weft yarns up and down. The warp yarns are arranged at intervals by conductive fibers and other warp yarns. The two ends of the artificial wool pass through the weft between the adjacent warp yarns, and the two ends protrude from the front of the base fabric 1 and the base fabric 2. The backs of the base fabric 1 and the base fabric 2 are respectively provided with adhesive layer 1 and adhesive layer 2. The parts of the artificial wool on the back of the base fabric 1 and the base fabric 2 are fixed by adhesive layer 1 and adhesive layer 2 in adhesive layer 1 and adhesive layer 2, respectively. The other side of adhesive layer is antibacterial layer 1, the other side of adhesive layer 2 is antibacterial layer 2, the other side of antibacterial layer 1 is adhesive layer 3, the other side of antibacterial layer 2 is adhesive layer 4, the other side of adhesive layer 3 and the other side of adhesive layer 4 are respectively waterproof layers. It can be used on both sides with good antibacterial and waterproof effect.

Regardless of the above-mentioned artificial fur, the material forming the fluff is generally synthetic fiber, animal hair, etc. These materials are monofilament without branch structure. When the synthetic fiber or animal hair is sheathed on the base yarn, one end of the synthetic fiber or animal hair passes through the base yarn from downward and then goes up from the other side of the base yarn, allowing the synthetic fiber or animal hair to protrude from the bottom yarn to form fluff, and the synthetic fiber or animal hair is clamped and fixed by the adjacent base yarn. In this way, once the clamping force is not enough, the phenomenon of hair removal is easy to occur, and each fluff is connected with the base yarn by a single interwoven point, and the strength of the connection is low, resulting in poor mechanical properties of the artificial fur. In addition, if thick fluff is to be formed, a lot of synthetic fiber or animal hair is needed.

Because the plush of the existing fur uses monofilament fibers or animal hair, it is impossible to form a reticular structure outside the base yarn woven layer.

In the current actual tanning production process, a large amount of leather leftovers will be produced, but the leather leftovers cannot be used better at present, causing great waste and environmental pollution.

SUMMARY

The first object of the present invention is to provide a novel fabric with collagen fiber bundles forming a reticular structure. With the structure of the present invention, the collagen fiber bundles and their branches are sheathed on the base yarn, and the collagen fibers bundles and their branches are interwoven on the surface of the base yarn woven layer to form a reticular structure. The new fabric has good mechanical properties and is widely used.

The second object of the present invention is to provide a novel fabric formed by collagen fiber bundle yarns. With the structure of the present invention, the novel fabric has good mechanical properties, a wide variety of products and a wide range of applications.

The third object of the present invention is to provide a brand-new leather product made of a new type of fabric using collagen fiber bundles to form a reticular structure. The leather product with this structure has good mechanical properties, can be washed with water, has the hygienic properties of real leather, and gives full play to the excellent properties of collagen fiber as a resource.

The fourth object of the present invention is to provide a new leather product made of a novel fabric formed by collagen fiber bundle yarns. The leather product with this structure has good mechanical properties, can be washed with water, has the hygienic properties of real leather, and gives full play to the excellent properties of collagen fiber as a resource.

In order to achieve the above-mentioned first object, a new type of fabric in which collagen fiber bundles form a reticular structure comprises a base yarn woven layer and collagen fiber bundles. The collagen fiber bundles sheathed in the base yarn woven layer protrude on the surface of the bottom yarn woven layer, and the protruding collagen fiber bundles and their branches interweave each other to form a reticular structure, wherein a part of the branches in the collagen fiber bundles is sheathed on the base yarn so that at least one end of the part of the branches protrudes from the base yarn braided layer.

Collagen fiber bundles are taken from animal leather. Leather is formed by removing the skin layer and subcutaneous tissue layer from the skin of the animal, and then performing a series of physical, mechanical and chemical treatments on the remaining dermis layer through tanning. Collagen fiber is the main fiber in the dermis, which constitutes the main body of the dermis, accounting for 95% to 98% of all the fibers in the dermis, and the collagen fibers are in bundles. The state of collagen fibers in leather is that collagen fiber bundles are sometimes divided into several thinner collagen fiber bundles. These thinner collagen fiber bundles can be combined with other collagen fiber bundles to form a thicker fiber bundle. In this way, it keeps dividing and closing, interweaving and crisscrossing each other to form a special three-dimensional mesh woven structure. When making a new type of fabric, the collagen fiber bundles need to be unraveled from the animal leather first, and then the collagen fiber bundles need to be combed and then put on the base yarn. When combing the collagen fiber bundles, the collagen fiber bundles continue to split, split into finer collagen fiber bundles or/and form hierarchical branches in the collagen fiber bundles. The thinner the main body of the fiber bundle, the finer the branches, and the more branches. In this way, when the collagen fiber bundle is sheathed into the base yarn braided layer and the base yarn is woven, not only the main body of the collagen fiber bundle is sheathed with the base yarn, but also some branches can be sheathed with the base yarn. In this way, the interweaving points of each collagen fiber bundle and the base yarn braided layer are greatly increased, so that the connection strength between the collagen fiber bundle and the base yarn braided layer is improved, and the phenomenon of hair loss is less likely to occur. In addition, since the collagen fibers have branches, the collagen fiber bundles and their branches are interwoven to form a reticular structure extending from the base yarn braided layer. The structure formed by the reticular structure and the base yarn braided layer greatly improves the strength and other mechanical properties of the novel fabric.

To sum up, the novel fabric of the present invention is relative to the structure of animal leather. (1) The novel fabric of the present invention is a reticular structure formed by collagen fiber bundles and their branches, which are sheathed on the base yarn braided layer with high structural strength, so that the collagen fiber bundles have a foundation, while the animal leather only forms a reticular structure, and its collagen fiber bundles do not have a foundation. (2) The collagen fiber bundles of the novel fabric of the present invention are interwoven reticular structure that is emitted from the base yarn braided layer. The reticular structure is controllable, and the reticular structure in animal leather will show different structures and levels of reticular structure due to the difference of the animal leather. The reticular structures of the two are different. (3) When forming a new type of fabric in the present invention, a series of processes such as dissolving and combing animal leather are required. In this way, collagen fiber bundles are mainly extracted to remove other fiber ingredients and non-fiber ingredients in animal leather. The novel fabric is mainly composed of collagen fiber bundles and base yarns, and contains no or very little non-fibrous ingredients such as inter-fibrous material. It is not easy to appear the phenomenon of fabric hardening due to the existence of inter-fibrous material. Therefore, the finished product can be washed with water. However, animal leather contains non-fibrous ingredients such as fibrous interstitium. After the animal leather gradually loses water, the fibers will solidify and become hard. In order to prevent the raw hides from hardening, fatliquors are usually added to the animal leather. The fatliquor plays the role of lubrication, and once the animal leather with fatliquor is washed with water, the fatliquor will be lost, causing the hide to become hard, so that it cannot be washed with water. (4) The novel fabric of the present invention is better than animal leather in properties such as mechanics and structure.

Compared with fur, the novel fabric of the present invention has a reticular structure interwoven by collagen fiber bundles and their branches in the shape of the base yarn, while the wool layer does not form a reticular structure in the existing fur. In addition, in the existing artificial fur, only monofilament fiber is sheathed with the base yarn, while the collagen fiber bundle and its branches are sheathed on the base yarn in the present invention. Therefore, the novel fabric of the present invention has high strength and good mechanical properties.

Further, the collagen fiber bundles form a reticular structure on one side of the base yarn braided layer or the collagen fiber bundles form a reticular structure on both sides of the base yarn braided layer, respectively.

Further, the collagen fiber bundle forms a structure composed of more than one continuously connected "V"-shaped tissue on the base yarn braided layer. In this way, the connection strength between the collagen fiber bundle and the base yarn can be improved.

Further, other textile fibers are mixed into the collagen fiber bundle, the collagen fiber bundle and its branches are interwoven with each other, and the collagen fiber bundle and its branches are interwoven with other textile fibers to form a reticular structure.

Further, the base yarn braided layer is a knitted or woven knitted layer.

Furthermore, the novel fabric formed by the base yarn braided layer and the reticular structure allows the collagen fiber bundles and their branches to be interwoven with the base yarn many times through a finishing process. In this way, there are many interweaving points between the collagen fiber bundle and the base yarn.

In order to achieve the second object, a new type of fabric formed by collagen fiber bundle yarns comprises a base yarn braided layer. The collagen fiber bundle yarn is sheathed on the base yarn in the base yarn braided layer and the collagen fiber bundle yarn protruding from the surface of the base yarn braided layer has a loose wool reticular structure.

The collagen fiber bundles form a special three-dimensional reticular braided structure as described above. When making a novel fabric with this structure, the yarns formed by the collagen fiber bundles are sheathed into the base yarn braided layer and the base yarn is braided into a loop, so that the collagen fiber bundle yarns sheathed into the base yarn are always yarns, and the collagen fiber bundle yarns protruding from the base yarn braided layer are in a loose reticular structure. In this way, the loose hair reticular structure is sheathed to the base yarn braid through the original collagen fiber bundle yarns at the root, so that the connection strength is high, and the phenomenon of hair loss is not easy to occur. Moreover, the collagen fiber bundles and their branches in the loose hair reticular structure are interwoven with each other. The structure formed by the collagen fiber bundle yarn and the base yarn braided layer greatly improves the strength and other mechanical properties of the novel fabric. The loose hair reticular structure is fluffy and has good warmth retention effect.

Furthermore, the collagen fiber bundle yarn protruding from the surface of the base yarn braided layer has a reticular structure in which the collagen fiber bundles and their branches are interwoven. The mechanical properties of the entire novel fabric are further improved.

Further, other textile fibers are mixed into the collagen fiber bundle yarn, the collagen fiber bundle and its branches are interwoven with each other, and the collagen fiber bundle and its branches are interwoven with other textile fibers to form a reticular structure.

Furthermore, the novel fabric formed by the base yarn braided layer and the reticular structure allows the collagen fiber bundles and their branches to be interwoven with the base yarn many times through a finishing process. In this way, there are many interweaving points between the collagen fiber bundle yarn and the base yarn.

In order to achieve the above-mentioned third object, a new leather product made of a novel fabric with a reticular structure formed by the collagen fiber bundles, which is provided with a leather surface layer on one side of the novel fabric. The new leather product with this structure has good mechanical properties due to the existence of the novel fabric. Since this new leather product does not contain or contains very few interstitial fibers, it can be washed with water. Moreover, it has the hygienic properties of real leather and gives full play to the excellent properties of collagen fiber as a resource.

In order to achieve the above-mentioned fourth object, a new leather product made of the novel fabric formed by the collagen fiber bundle yarn, which is provided with a leather surface layer on one side of the novel fabric. The new leather product with this structure has good mechanical properties due to the existence of the new fabric. Since this new leather product does not contain or contains very few interstitial fibers, it can be washed with water. Moreover, it has the hygienic properties of real leather and gives full play to the excellent properties of collagen fiber as a resource.

Since the above-mentioned novel fabrics can be used to produce a variety of other products, they are widely used.

In the current tanning industry, a large amount of leather leftovers are produced. In the country alone, there are approximately 1.4 million tons of leather leftovers per year. These leftovers are not only the natural and precious protein fiber resources bestowed by nature, but also contains a lot of chemical materials, electricity, heat, labor, etc. during the tanning process. Therefore, the development and reuse of this resource is extremely necessary.

DETAILED DESCRIPTION

The present invention will be further described in detail below with reference to the drawings and specific embodiments.

Embodiment 1

Figure 1:
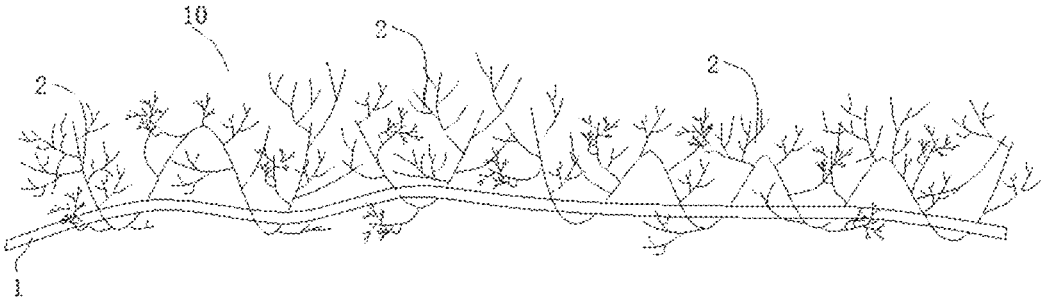
FIG. 1 is a schematic diagram of a novel fabric in which collagen fiber bundles form a reticular structure in Embodiment 1.

As shown in FIG. 1, the novel fabric in which collagen fiber bundles form a reticular structure comprises a base yarn braided layer 1 and collagen fiber bundles 2.

Figure 2:
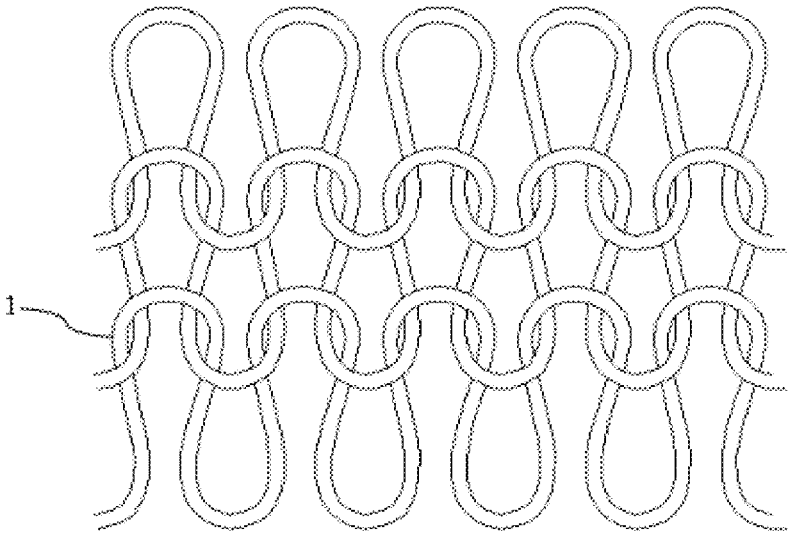
FIG. 2 is a schematic diagram of a knitting base yarn braided layer.
Figure 3:
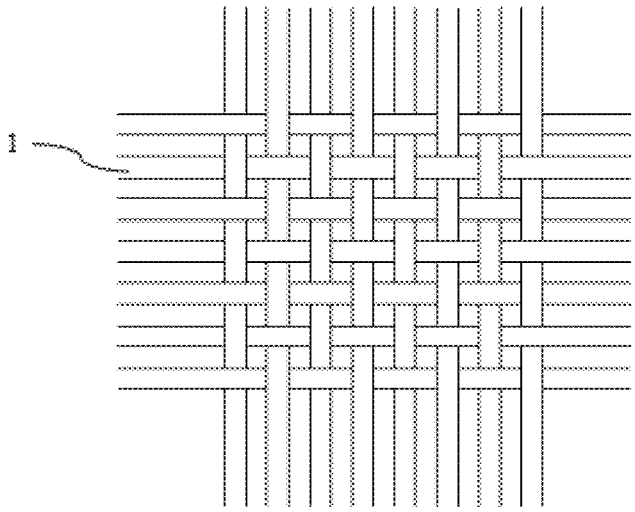
FIG. 3 is a schematic diagram of a woven base yarn braided layer.

As shown in FIG. 2, the base yarn braided layer 1 may be a knitted braided layer, or a woven braided layer as shown in FIG. 3. The base yarn braided layer can be woven by filament, or by short fiber yarn, or by mixing filament and short fiber yarn.

Figure 4:
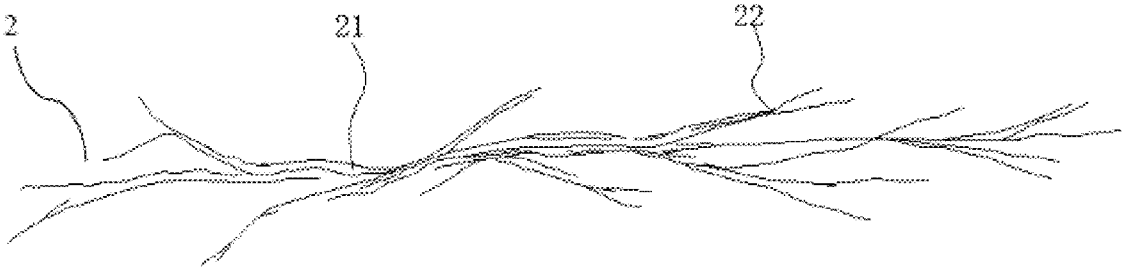
FIG. 4 is a schematic diagram of collagen fiber bundles.

As shown in FIG. 4, the collagen fiber bundle 2 is composed of a collagen fiber bundle body 21 and branches 22. The branch 22 is a gradual branch formed on the main body of the collagen fiber bundle. The gradual branch means that there are secondary branches from the main branch, and sub-branches are formed on the secondary branches, and so on.

Figure 5:
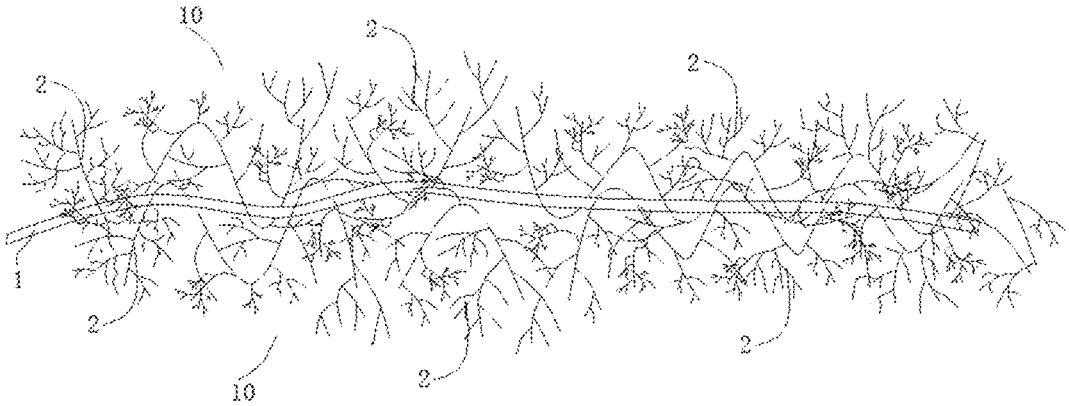
FIG. 5 is a schematic diagram of another structure of the novel fabric in which collagen fiber bundles form a reticular structure.

As shown in FIG. 1 and FIG. 5, the collagen fiber bundles 2 sheathed in the base yarn braided layer 1 protrude on the surface of the base yarn braided layer, and the protruding collagen fiber bundles and their branches are interwoven to form a reticular structure 10. A part of the branches of the collagen fiber bundle is sheathed on the base yarn so that at least one end of the part of the branches protrudes, and the collagen fiber bundles form a structure composed of more than one continuous "V"-shaped tissues on the base yarn braided layer. Of course, the collagen fiber bundles that form a reticular structure can also be mixed with other textile fibers, such as chemical fibers and natural fibers. When this structure is adopted, other textile fibers mixed in will also be woven with the base yarn, and other textile fibers will interweave with collagen fiber bundles and their branches to form a reticular structure. If other textile fibers are added, the weight percentage of other textile fibers in the reticular structure is less than 60%.

In the process of sheathing the collagen fiber bundle into the base yarn, the collagen fiber bundle can also be entangled and braided with the base yarn under the action of the reverse blowing device through the reverse blowing device, so that the collagen fiber bundle and its branches can form multiple continuous V or W-shaped tissue structures in the novel fabric, making the combination of collagen fiber bundles and base yarn stronger.

The novel fabric formed by the base yarn braided layer and the reticular structure allows the collagen fiber bundles and their branches to be interwoven with the base yarn multiple times through post-finishing processes such as needle punching or spunlacing to make the novel fabric more compact.

As shown in FIG. 1, a reticular structure is formed on one side of the base yarn braided layer. As shown in FIG. 5, a reticular structure is formed on both sides of the base yarn braided layer.

In the present invention, the reticular structure is formed by the interweaving of collagen fiber bundles and their branches. The reticular structure comprises branches that are sheathed in and protruding from the base yarn braided layer, branches that are not sheathed on the base yarn, and the main body of collagen fibers, which are interwoven with each other. In addition, the reticular structure protrudes from the bottom yarn braided layer, which is different from the special three-dimensional reticular structure of the existing leather.

The collagen fiber bundles are taken from animal leather. The leather is formed by tanning the skin peeled off from the animal body after removing the epidermal layer and subcutaneous tissue layer and performing a series of physical, mechanical and chemical treatments on the remaining dermis layer. The collagen fiber is the main fiber in the dermis, which constitutes the main body of the dermis, accounting for 95% to 98% of all the fibers in the dermis, and the collagen fibers are in bundles. The state of the collagen fibers in leather is that the collagen fiber bundles are sometimes divided into several thinner collagen fiber bundles. These thinner collagen fiber bundles can be combined with other collagen fiber bundles to form a thicker fiber bundle. In this way, it keeps dividing and closing, interweaving and criss-crossing each other to form a special three-dimensional reticular braided structure. When making a new type of fabric, the collagen fiber bundles need to be unraveled from the animal leather first, and then the collagen fiber bundles need to be combed and then put on the base yarn. When the collagen fiber bundles are combed, the collagen fiber bundles continue to split, split into finer collagen fiber bundles or/and form hierarchical branches in the collagen fiber bundles. The thinner the main body of the fiber bundle, the finer the branches and the more branches. In this way, when the collagen fiber bundle is sheathed into the base yarn braided layer and the base yarn is woven, not only the main body of the collagen fiber bundle is sheathed with the base yarn, but also some branches can be sheathed with the base yarn. In this way, the interweaving points of each collagen fiber bundle and the base yarn braided layer are greatly increased, so that the connection strength between the collagen fiber bundle and the base yarn braided layer is improved, and the phenomenon of hair loss is less likely to occur. In addition, since the collagen fibers have branches, the collagen fiber bundles and their branches are interwoven to form a reticular structure protruding from the base yarn braided layer. The structure formed by the reticular structure and the base yarn braided layer greatly improves the strength and other mechanical properties of the novel fabric.

To sum up, the novel fabric of the present invention is relative to the structure of animal leather. (1) The novel fabric of the present invention is a reticular structure formed by collagen fiber bundles and their branches, which are sheathed on the base yarn braided layer with high structural strength, so that the collagen fiber bundles have a foundation, while the animal leather only forms a reticular structure, and its collagen fiber bundles do not have a foundation. (2) The collagen fiber bundles of the novel fabric of the present invention is an interwoven reticular structure that is emitted from the base yarn braided layer. The reticular structure is controllable, and the reticular structure of the animal leather will show a different structure and level of the reticular structure due to the difference of the animal leather. The reticular structure of the two is different. (3) When forming a new type of fabric in the present invention, a series of processes such as dissolving and combing animal leather are required. In this way, the collagen fiber bundles are mainly extracted to remove other fiber ingredients and non-fiber ingredients in animal leather. The novel fabric is mainly composed of the collagen fiber bundles and base yarns, and contains no or very little non-fibrous ingredients such as fibrous interstitium. It is not easy to appear the phenomenon of fabric hardening due to the existence of fibrous interstitium. Therefore, the finished product can be washed with water, and animal leather contains non-fibrous ingredients such as fibrous interstitium. After the animal leather gradually loses water, the fibers will solidify and become hard. In order to prevent the raw hides from hardening, fatliquors are usually added to the animal leather, and the fatliquors play the role of lubrication, and once the animal leather with fatliquor is washed with water, the fatliquor will be lost, causing the hide to become hard, so that it cannot be washed with water. (4) The novel fabric of the present invention is better than animal leather in properties such as mechanics and structure.

Compared with fur, the novel fabric of the present invention has a reticular structure interwoven by collagen fiber bundles and their branches in the shape of the base yarn, while the wool layer does not form a reticular structure in the existing fur. In addition, in the existing artificial fur, only the monofilament fibers are sheathed with the base yarn, while the collagen fiber bundle and its branches are sheathed on the base yarn in the present invention. Therefore, the novel fabric of the present invention has high strength and good mechanical properties.

Embodiment 2

Figure 6:
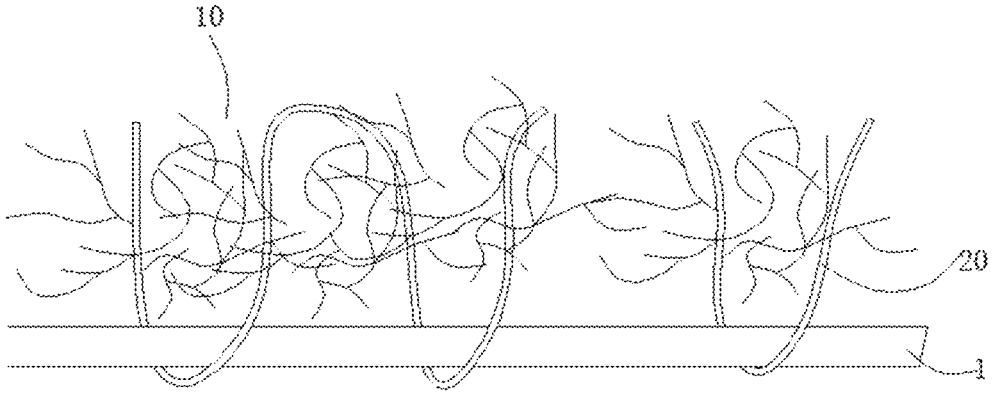
FIG. 6 is a schematic diagram of the novel fabric of Embodiment 2.

As shown in FIG. 6, the novel fabric formed by collagen fiber bundle yarns comprises a base yarn braided layer 1. As shown in FIG. 2, the base yarn braided layer 1 is the same as the Embodiment 1.

The collagen fiber bundle yarn 20 is sheathed on the base yarn in the base yarn braided layer 1, and the collagen fiber bundle yarn protruding from the surface of the base yarn braided layer 1 has a loose wool reticular structure 10.

The collagen fiber bundle yarn is made by twisting collagen fiber bundle or other processes. As shown in FIG. 4, the structure of the collagen fiber bundle 2 is the same as the embodiment.

The above-mentioned new type of fabric is made by feeding collagen fiber bundle yarns while weaving the base yarn braided layer. The collagen fiber bundle yarns are sheathed on the base yarn braided layer to form a loop, and then through cutting pile, brushing and other finishing processes. On the surface of the base yarn braided layer, a loose wool reticular structure in which the collagen fiber bundles and their branches are interwoven is formed.

The above-mentioned loose hair reticular structure may be formed on one side of the base yarn braided layer, or may be formed on both sides of the base yarn braided layer. However, the collagen fiber bundle yarns sheathed on the base yarn braided layer exist in the form of yarns.

As another embodiment, the collagen fiber bundle yarn may also contain other textile fibers, such as chemical fibers or natural fibers, and the weight percentage of other textile fibers in the reticular structure is less than 60%.

The collagen fiber bundles form a special three-dimensional reticular woven structure as described in Embodiment 1. When making a novel fabric with this structure, the yarns formed by the collagen fiber bundles are sheathed into the base yarn braided layer and the base yarn is woven into a loop, so that the collagen fiber bundle yarns sheathed into the base yarn are always yarns, and the collagen fiber bundle yarns protruding from the base yarn braided layer have a loose reticular structure. In this way, the loose hair reticular structure is connected to the base yarn braid through the original collagen fiber bundle yarns at the root, so that the connection strength is high. The phenomenon of hair loss is not easy to occur, and the collagen fiber bundles and their branches in the scattered hair reticular structure are interwoven with each other. The structure formed by the collagen fiber bundle yarn and the base yarn braided layer greatly improves the strength and other mechanical properties of the novel fabric. The loose hair reticular structure is fluffy and has good warmth retention effect.

Embodiment 3

Figure 7:
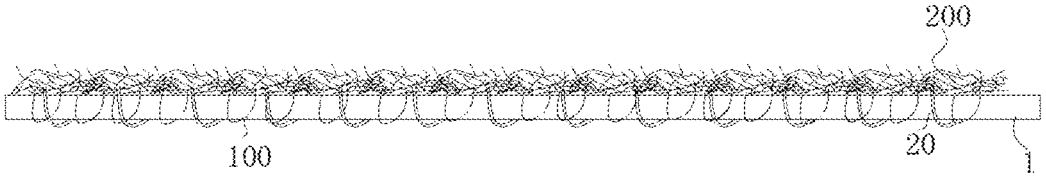
FIG. 7 is a schematic diagram of the novel fabric of Embodiment 3.

As shown in FIG. 7, the novel fabric formed by collagen fiber bundle yarns comprises a base yarn braided layer 1. As shown in FIG. 2, the base yarn braided layer 1 is the same as the Embodiment 1.

A collagen fiber bundle yarn 20 is sheathed on the base yarn in the base yarn braided layer 1, and the collagen fiber bundle yarn protruding from the surface of the base yarn braided layer 1 is a reticular structure 200 in which collagen fiber bundles and their branches are interwoven.

The Collagen fiber bundle yarn is made by twisting collagen fiber bundle or other processes. As shown in FIG. 4, the structure of the collagen fiber bundle 2 is the same as that of Embodiment 1.

The above-mentioned new type of fabric is made by feeding collagen fiber bundle yarns while weaving the base yarn braided layer. The collagen fiber bundle yarns are sheathed on the base yarn braided layer to form a loop, and then through the finishing processes such as cutting pile and brushing, the collagen fiber bundle and its branches are interwoven on the surface of the base yarn braided layer to form a loose wool reticular structure. Finally, after finishing processes such as acupuncture or spunlace, a dense reticular structure in which collagen fiber bundles and their branches are interwoven is formed on the surface of the bottom yarn braid. At the same time, some collagen fiber bundles and their branches are sheathed on the base yarn braid.

Another method of making the above-mentioned novel fabric is to feed the collagen fiber bundle yarn while weaving the base yarn braided layer, and the collagen fiber bundle yarn is sheathed on the base yarn braided layer to form a loop, then the looped collagen fiber bundle yarn protruding from the base yarn braid layer is opened through the finishing process such as needle punching or spunlacing, and then the looped collagen bundle yarn and the adjacent looped collagen fiber bundle yarn are interwoven again to re-establish a new dense reticular structure of collagen fiber bundles and their branches intertwined. At the same time, part of the collagen fiber bundles and their branches 100 are sheathed on the base yarn braid.

The aforementioned reticular structure may be formed on one side of the base yarn braided layer, or may be formed on both sides of the base yarn braided layer. However, the collagen fiber bundle yarns sheathed on the base yarn braided layer exist in the form of yarns.

As another embodiment, the collagen fiber bundle yarn may also comprise other textile fibers, such as chemical fibers or natural fibers, and the weight percentage of other textile fibers in the network structure is less than 60%.

The collagen fiber bundles form a special three-dimensional reticular woven structure as described in Embodiment 1. When making a novel fabric with this structure, the yarns formed by the collagen fiber bundles are sheathed into the base yarn braided layer and the base yarn is woven into a loop, so that the collagen fiber bundle yarns sheathed into the base yarn are always yarns, and after the collagen fiber bundle yarns protruding from the base yarn braided layer are dispersed, the collagen fiber bundle yarn is a reticular structure of collagen fiber bundles and their branches interwoven. In this way, the reticular structure is connected to the base yarn braided layer through the original collagen fiber bundle yarns at the root, so that the connection strength is high, the phenomenon of hair loss is not easy to occur, the collagen fiber bundles and their branches in the reticular structure are interwoven with each other, and part of the collagen fiber bundles and their branches can also be sheathed on the base yarn. The structure formed by the collagen fiber bundle yarn and the base yarn braided layer greatly improves the strength and other mechanical properties of the novel fabric.

Since the novel fabric in the embodiment can be used to produce a variety of other products, it is widely used.

In the current tanning industry, a large amount of leather leftovers are produced. In my country alone, there are about 1.4 million tons of leather leftovers. These leftovers are not only the natural and precious protein fiber resources bestowed by nature, but also contain a lot of chemical materials, electricity, heat, labor, etc. during the tanning process. Therefore, the development and reuse of this resource is extremely necessary.

In practical applications, the novel fabric can also be combined with the leather surface layer to form a new leather product with a reticular structure. The leather surface layer is PU or PVC. The leather surface layer can also be formed by coating or pasting other materials. The novel fabric and leather surface layer are made by existing methods. Since this new leather product does not contain or contains very few interstitial fibers, it can be washed with water. Moreover, it has the hygienic properties of real leather and gives full play to the excellent properties of collagen fiber as a resource. Of course, new fabrics can also be made into blankets, fabrics, etc. Since the above-mentioned new fabrics can be used to produce a variety of products, they are widely used.

What is claimed is:

1. A fabric, comprising:

a base yarn braided layer formed by knitting or weaving strands of base yarn;

collagen fiber bundles and their branches fed while knitting or weaving the base yarn braided layer, wherein the collagen fiber bundles and their branches protrude from a surface of the base yarn braided layer and are intertwined to form a reticular structure;

wherein the reticular structure protrudes from at least one side of the base yarn braided layer.

2. The fabric according to claim 1, wherein the collagen fiber bundle forms a structure comprising more than one continuously connected "V"-shaped tissue on the base yarn braided layer.

3. The fabric according to claim 1, wherein other textile fibers are mixed in the collagen fiber bundles, and the collagen fiber bundles and their branches are interwoven with each other, and the collagen fiber bundles and their branches are interwoven with other textile fibers to form a reticular structure.

4. The fabric according to claim 1, further comprising a surface layer.

5. The fabric according to claim 4, wherein the surface layer is PU or PVC.

6. The fabric according to claim 4, wherein the surface layer is provided on one side of the fabric.

* * * * *